United States Patent [19]

Igarashi

[11] Patent Number: 4,719,827

[45] Date of Patent: Jan. 19, 1988

[54] TONGUE-AND-GROOVE PLIERS

[75] Inventor: Tsutomu Igarashi, Sanjo, Japan

[73] Assignee: Igarashi Plier Co., Ltd., Mitsuke, Japan

[21] Appl. No.: 854,758

[22] Filed: Apr. 22, 1986

[30] Foreign Application Priority Data

Nov. 2, 1985 [JP] Japan ..... 60-169460[U]

[51] Int. Cl.[4] ..... B25B 7/06

[52] U.S. Cl. ..... 81/417; 81/416; 81/414

[58] Field of Search ..... 81/414, 416, 417, 427, 81/407, 409.5, 411, 348, 351, 342, 394, 385, 405

[56] References Cited

U.S. PATENT DOCUMENTS

| | | | |
|---|---|---|---|
| 3,176,551 | 4/1965 | Hanson | 81/417 |
| 4,669,340 | 6/1987 | Igarashi | 81/416 |

FOREIGN PATENT DOCUMENTS

| | | | |
|---|---|---|---|
| 1060330 | 6/1959 | Fed. Rep. of Germany | 81/409.5 |
| 57-170959 | 10/1982 | Japan . | |
| 59-127562 | 8/1984 | Japan . | |

*Primary Examiner*—Robert P. Olszewski
*Assistant Examiner*—Bradley I. Vaught
*Attorney, Agent, or Firm*—Wenderoth, Lind & Ponack

[57] ABSTRACT

Tongue-and-groove pliers comprises a pair of plier members each having a jaw portion, a joint portion and a handle portion, a pivotal bolt, a nut, a spring member and a pressure transmitting member. The joint portion of one of the pair of plier members has a bolt hole, an annular groove including a through hole, and an arcuate protuberance. The joint portion of the other plier member has an oblong slot and a plurality of arcuate adjustable channels with which the arcuate protuberance is engaged. The spring member has a gap, a long downward projection and a short downward projection and is accommodated within the annular groove about the bolt hole. The pressure transmitting member has an insertion hole for the pivotal bolt and an engaging hole for the long downward projection of the spring member and is loosely fitted movably in the oblong slot of the other plier member. With the construction the jaw portions of the tongue-and-groove pliers can automatically be opened by cooperation of the spring member and the pressure transmitting member.

1 Claim, 5 Drawing Figures

TONGUE-AND-GROOVE PLIERS

FIELD OF THE INVENTION AND RELATED ART STATEMENT

The present invention relates to tongue-and-groove pliers provided integrally with a mechanism for automatically opening the jaw portions thereof.

Generally, water pump pliers comprises a pair of plier members each having a jaw portion, a joint portion and a handle portion and is constructed either such that a pivotal shaft is fixed to the joint portion of one plier member and is fitted in an oblong slot formed in the joint portion of the other plier member and provided on one side wall thereof with corrugated portions with which the pivotal shaft is engaged and that the opening angle of the jaw portions can freely be adjusted by shifting the engagement position of the pivotal shaft relative to the corrugated portions of the oblong slot or such that the joint portion of one plier member is provided on the inner surface with an arcuate protuberance which is engageable with any arcuate adjustable channels formed about an oblong slot bored in the joint portion of the other plier member and that the opening angle of the jaw portions can freely be adjusted by shifting the engagement position of the arcuate protuberance relative to the arcuate adjustable channels. The water pump pliers of the latter construction, which is so-called tongue-and-groove pliers, is used preferably to the water pump pliers of the former construction from a standpoint of engagement strength and engagement reliability.

On the other hand, hand tools such as ordinary pincers, nippers and pliers are desired to have their jaw or nose portions set open at all times from a standpoint of working convenience. To satisfy this desire, there have heretofore been proposed such hand tools having a mechanism for automatically opening the jaw or nose portions as in Japanese Utility Model Public Disclosure No. 57-170959 and Japanese Utility Model Public Disclosure No. 59-127562, for example. In the former related art, opposite ends of a twisted coil spring are fixed to respective handle portions of a hand tool at a position in the vicinity of a pivot portion of the hand tool to apply spring pressure to the handle portions, thereby ensuring the automatic jaw or nose portion opening state. The latter related art has an ordinary coil spring interposed between opposed handle portions of a hand tool in the vicinity of a pivot portion of the hand tool and guarantees the automatic jaw or nose portion opening state by utilization of the spring pressure.

These mechanisms for automatically opening the jaw or nose portions of a hand tool, however, can only be adopted for ordinary pliers or the like having a pair of symmetrical plier members and being unnecessary to spread the handle portions relatively widely. In other words, the conventional mechanisms cannot be applied, from technical and structural points of view, to tongue-and-groove pliers having a pair of asymmetrical plier members and, in adjusting the opening angle of the jaw portions, requiring the handle portions to be widely spread. For this reason, there has not yet been proposed an automatic jaw portion opening mechanism advantageously usable for tongue-and-groove pliers in spite of the fact that there is an eager demand therefor from a standpoint of working convenience and, therefore, the fact is that tongue-and-groove pliers having no such mechanism has been put to practical use.

OBJECT AND SUMMARY OF THE INVENTION

The main object of the present invention is to provide tongue-and-groove pliers capable of automatically opening the jaw portions with a very simple construction.

To attain the object described above, according to the present invention, there is provided tongue-and-groove pliers comprising a pair of plier members each having a jaw portion, a joint portion and a handle portion, one of the pair of plier members having a bolt hole bored in the joint portion thereof for passing a pivotal bolt therethrough and also having an arcuate protuberance formed on the inner surface of the joint portion thereof so as to be concentric relative to the bolt hole, the other of the pair of plier members having an oblong slot bored in the joint portion thereof for admitting the pivotal bolt so as to be movable therein and also having a plurality of adjustable channels formed in the inner surface of the joint portion thereof about the oblong slot in an arcuate shape as being engageable with the arcuate protuberance of the one plier member, a spring member formed in a ring shape with a gap and provided on one end thereof with a short downward projection and on the other end thereof with a long downward projection, the joint portion of the one plier member having an annular groove formed in the outer surface thereof about the bolt hole for accommodating therein the spring member and also having a through hole formed by piercing through part of the bottom of the annular groove so as to have a length larger than a distance between the long downward projection and the short downward projection of the spring member, the long downward projection of the spring member accommodated within the annular groove being projected downwardly from the through hole, the short downward projection of the spring member accommodated within the annular groove being stopped by the edge of the through hole without being projected downwardly from the through hole, a pressure transmitting member having an insertion hole for inserting the pivotal bolt thereinto and an engaging hole for engaging therein the long downward projection of the spring member and being loosely fitted movably in the oblong slot of the other plier member, and a nut for holding therewith the pivotal bolt having been passed through the bolt hole in the joint portion of the one plier member and the insertion hole in the pressure transmitting member and admitted in the oblong slot in the joint portion of the other plier member in its place, whereby the jaw portions of the pair of plier members are automatically opened by cooperation of the spring member and the pressure transmitting member.

The above and other objects, characteristic features and advantages of the present invention will become apparent to those skilled in the art as the disclosure is made in the following description of a preferred embodiment of the invention, as illustrated in the accompanying drawings.

DESCRIPTION OF THE PREFERRED EMBODIMENT

Figure 1:
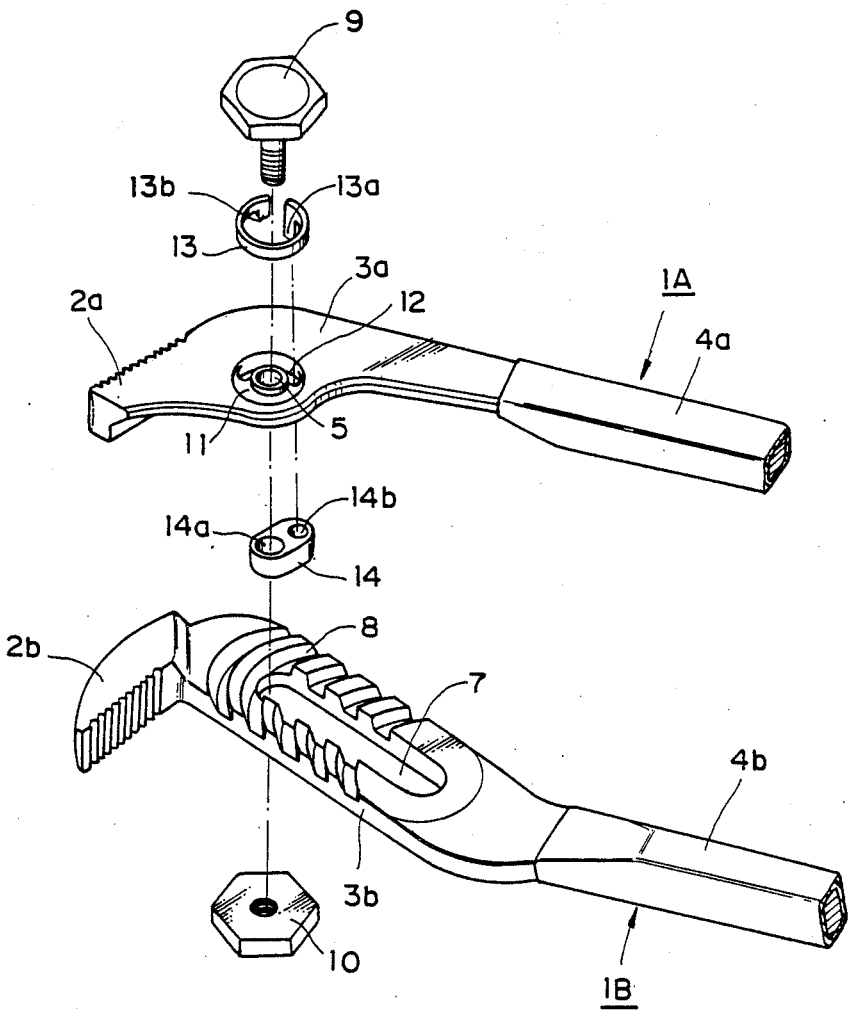
FIG. 1 is an exploded perspective view illustrating principal part of one embodiment of the tongue-and-groove pliers according to the present invention.
Figure 2:
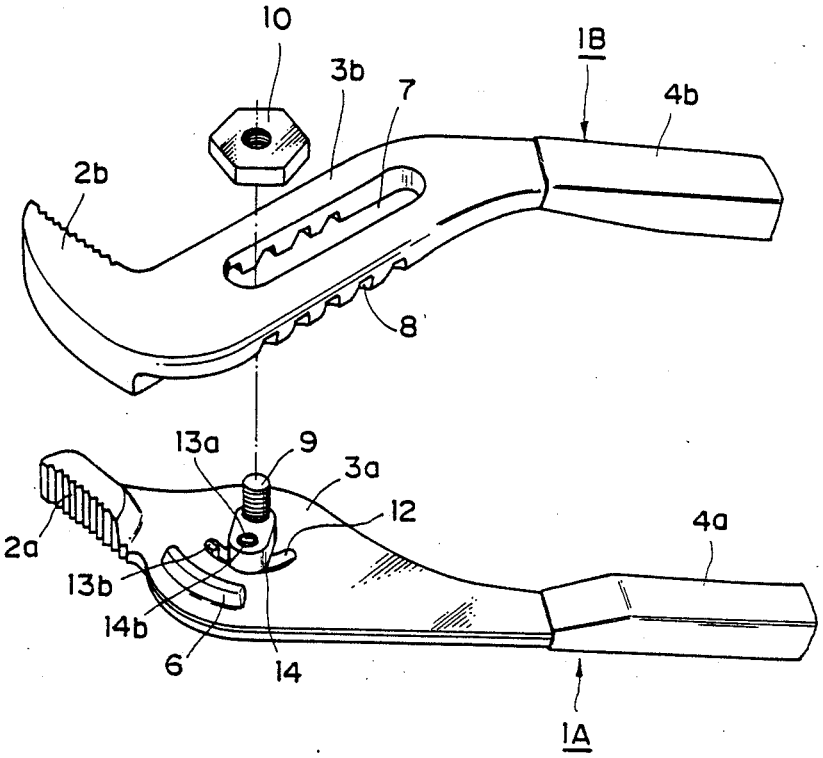
FIG. 2 is an exploded perspective view illustrating the principal part of the embodiment in a state assumed during the course of assemblage.
Figure 3:
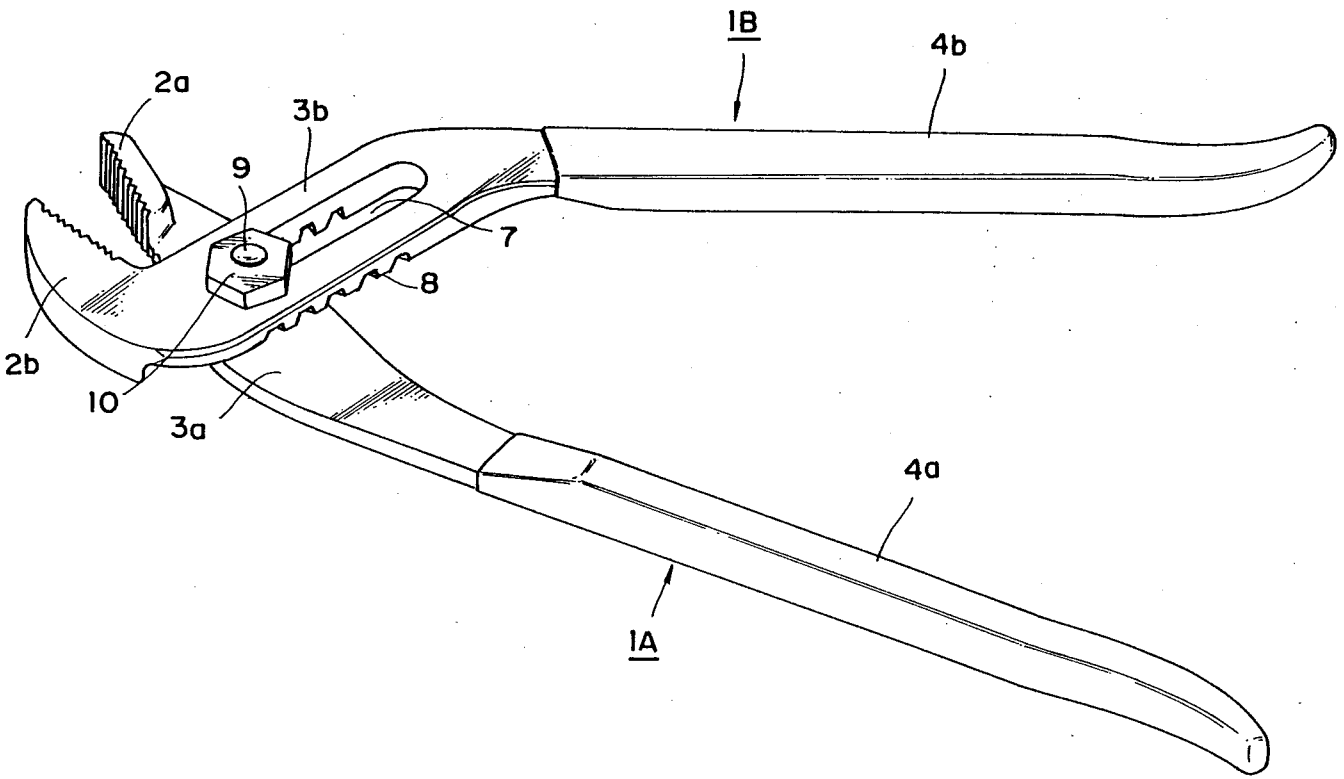
FIG. 3 is a perspective view illustrating the embodiment as a whole in an assembled state.

The present invention will now be described with reference to the illustrated embodiment. As illustrated in FIG. 1 to FIG. 3, tongue-and-groove pliers according to the present invention comprises a pair of plier members 1A and 1B having jaw portions 2*a* and 2*b*, joint portions 3*a* and 3*b* and handle portions 4*a* and 4*b*, respectively. The joint portion 3*a* of the plier member 1A has a bolt hole 5 bored therein as shown in FIG. 1 and, as shown in FIG. 2, also has an arcuate protuberance 6 provided on the inner surface thereof so as to be concentric relative to the bolt hole 5 into which a pivotal bolt 9 is inserted. The joint portion 3*b* of the plier member 1B has an oblong slot 7 bored therein for allowing movement of the pivotal bolt 9 therein and also has a plurality of adjustable channels 8 formed in the inner surface thereof about the oblong slot 7 in an arcuate shape as being engageable with the arcuate protuberance 6 formed on the inner surface of the joint portion 3*a* of the plier member 1A. The pair of plier members 1A and 1B are pivotally attached to each other into tongue-and-groove pliers, with the jaw portions 2*a* and 2*b* set capable of being close to and apart from each other, by causing the arcuate protuberance 6 to engage in any one of the adjustable channels 8, passing the pivotal bolt 9 through the bolt hole 5 in the joint portion 3*a* and the oblong slot 7 in the joint portion 3*b*, holding the pivotal bolt 9 in its place with a nut 10 and calking the leading end of the pivotal bolt 9 projecting from the nut 10. The tongue-and-groove pliers of the present invention and ordinarily known tongue-and-groove pliers are in common with each other in the aforementioned aspects.

The present embodiment, however, further comprises a spring member 13 serving as a pressure source for opening the jaw portions 2*a* and 2*b* and a pressure transmitting member 14 adapted to transmit the pressure of the spring member 13 to the plier member 1B. Further, in this embodiment, the outer surface of the joint portion 3*a* of the plier member 1A has an annular groove 11 formed about the bolt hole 5 and a through hole 12 formed by piercing through part of the bottom of the annular groove 11 toward the inner surface of the joint portion 3*a*. The spring member 13 is accommodated within the annular groove 11 including the through hole 12 so as not to project upwardly from the annular groove 11.

To be specific, the spring member 13 is made from a resilient rod or plate material and formed in the shape of a ring with a gap so as to have its one end provided integrally with a long downward projection 13*a* which projects from the through hole 12 toward the side of the plier member 1B when the spring member 13 has been accommodated in the annular groove 11 and also have its other end provided integrally with a short downward projection 13*b* which is engaged with the wall surface of the through hole 12 without projecting from the through hole 12 in the state of the spring member 13 having been accommodated in the annular groove 11. On the other hand, the pressure transmitting member 14 for transmitting the pressure of the spring member 13 to the plier member 1B has bored therein an insertion hole 14*a* for allowing rotatable insertion of the pivotal bolt 9 and an engaging hole 14*b* for allowing engagement of the long downward projection 13*a* of the spring member 13, and is loosely fitted in the oblong slot 7 in the state of having the pivotal bolt passed through the insertion hole 14*a* and the long downward projection of the spring member engaged in the engaging hole 14*b*.

The pair of plier members 1A and 1B are assembled into tongue-and-groove pliers by the steps of completely accommodating the spring member 13 within the annular groove 11 with the long and short downward projections 13*a* and 13*b* inserted into the through hole 12, then passing the pivotal bolt 9 through the bolt hole 5 from the outer surface of the plier member 1A, subsequently passing the pivotal bolt 9 through the insertion hole 14*a* of the pressure transmitting member 14 and simultaneously inserting into the engaging hole 14*b* of the pressure transmitting member 14 the long downward projection 13*a* of the spring member 13 projecting from the through hole 12 to thereby attach the pressure transmitting member 14 to the plier member 1A to be rotatable about the pivotal bolt 9 with the long and short downward projections 13*a* and 13*b* of the spring member 13 engaged respectively with the wall surfaces of the engaging hole 14*b* and the through hole 12 as illustrated in FIG. 2, thereafter loosely fitting the pressure transmitting member 14 in the oblong slot 7 of the plier member 1B and at the same time engaging the arcuate protuberance 6 in any one of the plurality of arcuate adjustable channels 8, then holding the leading end of the pivotal bolt 9 projecting from the oblong hole 7 in place with the nut 10, and finally calking the leading end of the pivotal bolt 9 projecting from the nut 10. The tongue-and-groove pliers of the present invention thus assembled is identical in appearance with the conventional tongue-and-groove pliers as shown in FIG. 3.

Figure 4:
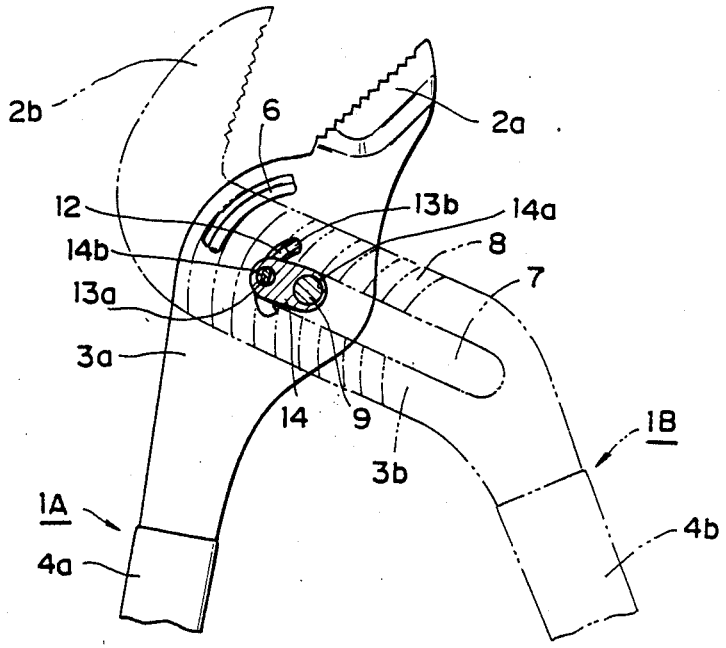
FIG. 4 is a partially cutaway plan view illustrating the embodiment in a state having jaw portions thereof opened automatically.
Figure 5:
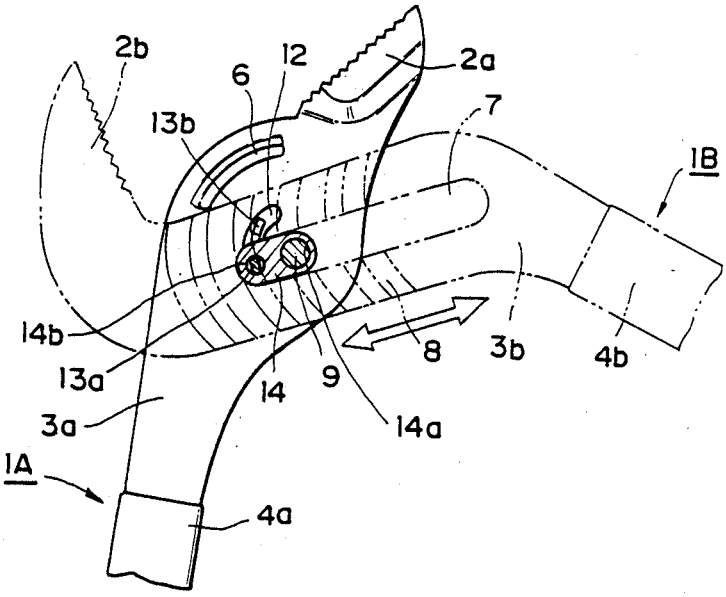
FIG. 5 is a partially cutaway plan view illustrating the embodiment in a state having the opening angle of the jaw portions adjusted.

In the tongue-and-groove pliers of the present invention, however, since the short downward projection 13*b* of the spring member 13 accommodated within the annular groove 11 in one plier member 1A is brought into collision with the wall surface of the through hole 12 on the side of the jaw portion 2*a* as illustrated in FIG. 4, the pressure transmitting member 14 loosely fitted in the oblong slot 7 and having the long downward projection 13*a* of the spring member 13 engaged in the engaging hole 14*b* thereof transmits the spring pressure produced by the long downward projection 13*a* to the other plier member 1B. Therefore, the handle portion 4*b* of the other plier member 1B is prevented with exactitude from moving toward the handle portion 4*a* of the one plier member 1A. Thus, the automatic opening state of the jaw portions 2*a* and 2*b* can precisely be guaranteed. The jaw portions 2*a* and 2*b* can be closed against the spring pressure of the spring member 13 by forcibly grasping the handle portions 4*a* and 4*b* and, therefore, the tongue-and-groove pliers of the present invention can be used without hindrance. As soon as the forcible grasp is released, the spring pressure of the spring member 13 is transmitted through the pressure transmitting member 14 to the other plier member 1B to ensure automatic opening state of the jaw portions 2a and 2b.

The opening angle of the jaw portions 2a and 2b can freely be adjusted by spreading the handle portions 4a and 4b to the fullest extent to disengage the arcuate protuberance 6 from the arcuate adjustable channel 8 and simultaneously permit the long and short downward projections 13a and 13b of the spring member 13 to move toward the side of the handle portion 4a within the through hole 12 with the rotation of the pressure transmitting member 14, and then engaging the arcuate protuberance 6 in any desired one of the arcuate adjustable channels 8.

When the handle portions 4a and 4b are closed after the completion of the opening angle adjustment, the long and short downward projections 13a and 13b of the spring member 13 are moved within the through hole 12 with the rotation of the pressure transmitting member 14 until the short downward projection 13a collides with the wall surface of the through hole 12 on the side of the jaw portion 2a. Thus, the automatic jaw portion opening state is again guaranteed.

As described above, according to the present invention, it is made possible to automatically open the jaw portions of tongue-and-groove pliers with a very simple construction comprising the annular groove including the through hole formed about the bolt hole in one of the plier members, the spring member having the long and short downward projections across the gap and being accommodated within the annular groove, and the pressure transmitting member having the insertion hole and engaging hole, being rotatably attached to the pivotal bolt, having the long downward projection of the spring member engaged in the engaging hole and being loosely fitted in the oblong slot in the other plier member. Further, since the spring member serving as a pressure source for automatically opening the jaw portions is accommodated within the annular groove without projecting therefrom, it neither makes the tongue-and-groove pliers look worse nor constitutes any obstacle to use of the tongue-and-groove pliers, but does ensure the automatic opening state of the jaw portions with exactitude in cooperation with the pressure transmitting member. Therefore, the disadvantage and inconvenience suffered by the conventional tongue-and-groove pliers while at work can be completely eliminated.

What is claimed is:

1. In tongue-and-groove pliers comprising a pair of plier members each having a jaw portion, a joint portion and a handle portion, one of the pair of plier members having a bolt hole bored in the joint portion thereof for passing a pivotal bolt therethrough and also having an arcuate protuberance formed on the inner surface of the joint portion thereof so as to be concentric relative to the bolt hole, the other one of the pair of plier members having an oblong slot bored in the joint portion thereof for admitting the pivotal bolt so as to be movable therein and also having a plurality of adjustable channels formed in the inner surface of the joint portion thereof about the oblong slot in an arcuate shape as being engageable with the arcuate protuberance of the one plier member, and a nut for holding therewith the pivotal bolt having been passed through the bolt hole and admitted in the oblong slot in its place, the leading end of the pivotal bolt projecting from the nut being calked, the improvement comprising:

a spring member formed in a ring shape with a gap and provided on one end thereof with a long downward projection and on the other end thereof with a short downward projection, the joint portion of the one plier member having an annular groove formed in the outer surface thereof about the bolt hole for accommodating therein said spring member and also having a through hole formed by piercing through part of the bottom of the annular groove so as to have a length larger than a distance between said long downward projection and said short downward projection of said spring member, said long downward projection of said spring member accommodated within said annular groove being projected downwardly from said through hole, said short downward projection of said spring member accommodated within said annular groove being stopped by an edge of said through hole without being projected downwardly from said through hole, and a pressure transmitting member having an insertion hole for inserting the pivotal bolt thereinto and an engaging hole for engaging therein said long downward projection of said spring member which projects downwardly from said through hole, and being loosely fitted movably in the oblong slot of the other plier member, whereby said spring member serves as a pressure source for opening the jaw portions of the pair of plier members and said pressure transmitting member serves to transmit the pressure of said spring member to the other plier member, and cooperation of said spring member and said pressure transmitting member causes the jaw portions to be opened automatically.

* * * * *